US011545312B2

(12) United States Patent
Rakus et al.

(10) Patent No.: US 11,545,312 B2
(45) Date of Patent: Jan. 3, 2023

(54) SWITCHING DEVICE WITH IMPROVED CLOSING PREVENTION

(71) Applicant: Eaton Intelligent Power Limited, Dublin (IE)

(72) Inventors: Paul R. Rakus, Coraopolis, PA (US); David R. Rohn, Venetia, PA (US); James L. Lagree, Robinson Township, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 246 days.

(21) Appl. No.: 16/913,136

(22) Filed: Jun. 26, 2020

(65) Prior Publication Data

US 2021/0193402 A1 Jun. 24, 2021

Related U.S. Application Data

(60) Provisional application No. 62/953,281, filed on Dec. 24, 2019.

(51) Int. Cl.
*H01H 3/32* (2006.01)
*H01H 9/20* (2006.01)

(52) U.S. Cl.
CPC ..... *H01H 3/32* (2013.01); *H01H 9/20* (2013.01); *H01H 2235/01* (2013.01)

(58) Field of Classification Search
USPC ..... 307/125
See application file for complete search history.

(56) References Cited

U.S. PATENT DOCUMENTS 7,186,937 B1 3/2007 Ricciuti et al.
2008/0302645 A1* 12/2008 Rakus ..... H01H 71/46 200/337
2012/0085627 A1 4/2012 Yang
2015/0153414 A1* 6/2015 Mills ..... G01R 31/327 324/424

FOREIGN PATENT DOCUMENTS

EP 1098344 A2 5/2001
EP 2001032 A1 12/2008

* cited by examiner

*Primary Examiner* — Toan T Vu
*Assistant Examiner* — Xuan Ly
(74) *Attorney, Agent, or Firm* — Eckert Seamans Cherin & Mellott, LLC

(57) ABSTRACT

A stored energy-type circuit breaker includes a sensor that operates as a full open sensor, and that is used to prevent the circuit breaker from closing in response to either a closing signal or a manual operation. The full open sensor exhibits a first output condition when the moveable contact is in a fully open position and a second output condition when the moveable contact begins to leave the fully open position. An electronic trip unit (ETU) is electrically connected to the sensor and, when in a close break mode, blocks the circuit breaker from closing. The ETU does this by, upon detecting that the sensor is in the second output condition, generating a signal that will cause the breaker's opening spring to return the moveable contact to the fully open position.

16 Claims, 11 Drawing Sheets

SWITCHING DEVICE WITH IMPROVED CLOSING PREVENTION

RELATED APPLICATIONS AND CLAIM OF PRIORITY

This patent document claims priority to U.S. Provisional Patent Application No. 62/953,281, filed Dec. 24, 2019. The disclosure of the priority application is fully incorporated into this document by reference.

BACKGROUND

This disclosure generally relates to electrical switching devices such as circuit breakers. More particularly, this disclosure describes a switching device having an improved design to help prevent the device's switch from closing if closure would cause an unsafe condition.

In a self-contained switching device such as a circuit breaker with an electronic trip unit (ETU), features are sometimes added to prevent closing the device and completing the primary circuit. These are often user-configurable features of the ETU that protect against closure if the closure would cause an unsafe condition. A simple example of an unsafe condition is a ground fault or other overcurrent condition. As another example, in power delivery systems that supply two loads from two power sources in a main-tie-main configuration, closing the system's tie breaker when the sources are not well-matched in voltage, frequency or phase could cause damage to system components. If the tie breaker's ETU detects such a mismatch, or if a remote controller that is monitoring the system detects the mismatch, the ETU or remote controller may respond by blocking any attempts to close the tie breaker.

Configurations in which the ETU or remote controller prevents closing are effective when the close command is initiated electronically, such as by a remote or local electrical actuator. In such situations, the system's programming may prioritize a "block closure" command over a command to close the switch. However, such configurations are not effective to block closure when closure is initiated locally by physical action, such as by an operator who depresses a mechanical pushbutton to manually operate the switch. This ineffectiveness occurs because electronic logic cannot intervene in the direct mechanical actuation of the circuit breaker mechanism. In order to prevent closing, the circuit breaker's ETU would need to operate the trip actuator and override the closing attempt, but trip actuators are typically intermittent operation devices and are not always maintained in an active state. Further, the trip actuators of some circuit breakers cannot mechanically operate to stop a close attempt when the circuit breaker is open. This is because the circuit breaker mechanism holds the trip actuator mechanism in the reset position whenever the switch is open. Further, ETUs of prior art circuit breakers typically will not detect when closure starts, but instead will only detect when the breaker's contacts touch, at which point it will have been too late to prevent the closure from happening. Even a few milliseconds of closure could damage system components and/or create safety hazards in overcurrent or voltage mismatch conditions.

This document describes an improved switching mechanism that is designed to help prevent closure of a switching device, even if the closure is initiated manually, when closure could result in an unsafe condition.

SUMMARY

In various embodiments, a circuit breaker includes a moveable contact, an opening spring that is operably connected to the moveable contact, and a sensor that operates as a full open sensor. The sensor exhibits a first output condition when the moveable contact is in a fully open position, and it exhibits a second output condition when the moveable contact leaves the fully open position. An electronic trip unit (ETU) is electrically connected to the sensor and, when in a close break mode, blocks the circuit breaker from closing. The ETU does this by, in response to detecting that the sensor is in the second output condition (which corresponds to the moveable contact leaving the fully open position), generating a signal that will cause the opening spring to return the moveable contact to the fully open position.

In some embodiments, the circuit breaker may include a trip actuator. The circuit breaker also may include an opening latch that, when in a latched position, will hold a linkage in a position which allows closing, and which thus holds the opening spring in a loaded position. In these embodiments, to cause the opening spring to return the moveable contact to the fully open position unit, the ETU's signal may cause the trip actuator to release the opening latch. Releasing the opening latch will allow the linkage to move and permit the opening spring to return to an unloaded condition. When the opening spring returns to its unloaded condition, the moveable contact will return to the fully open position. Optionally, the trip actuator may include a plunger having a retracted position and an extended position. The extended position may be operably connected to the opening latch. When the trip actuator receives the signal from ETU, the trip actuator will cause the plunger to move from the retracted position to the extended position and thus release the opening latch. When the moveable contact returns to the fully open position, the trip actuator will be reset.

In various embodiments, the circuit breaker may include: a moveable arm that is operably connected to the moveable contact, and an axle that is operably and rotatably connected to the moveable arm. The circuit breaker also may include a linkage that operably connects the opening spring with the moveable arm via the axle, along with an extended member (such as a cam) that is connected to the axle. The sensor may be positioned to detect the extended member when a position of the moveable contact corresponds to the fully open position. Alternatively, the sensor may be configured to detect a rotational position of the axle.

Other embodiments are directed to a method of operating a circuit breaker that has a moveable contact, an opening spring, a sensor and an ETU. The method includes, by the sensor, detecting that the moveable contact is in a fully open position. After the sensor initially detects that the moveable contact is in the fully open position, the sensor may detect that the moveable contact has moved away from the fully open position. When this happens, then in response the sensor will change from a first output condition to a second output condition (such as from off to on, or from on to off). When the ETU detects that the sensor has changed to the second output condition, then in response it will cause the opening spring to return the moveable contact to the fully open position.

In some embodiments of the method, the circuit breaker also includes an opening latch that is operably connected to the opening spring. In such embodiments, causing the opening spring to return the moveable contact to the fully open position may be effected as the ETU causes the opening latch to release, which in turn causes the opening spring to relax (i.e., return to an unloaded condition). The opening spring may be operably connected to a lever that is operably connected to an axle, and the moveable contact is operably connected to a moveable arm that is also operably connected to the axle. In such a case, causing the opening spring to retract to the unextended condition may turn the axle, turning the axle rotates the moveable arm, and rotating the moveable arm moves the moveable contact to the fully open position. The axle may include an extended member (such as a cam). Detecting that the moveable contact is in the fully open position may include detecting, by the sensor that the extended member has moved away from the sensor or that the extended member has moved over the sensor. Other sensors (such as a sensor that detects rotational position of the axle) may be used to detect whether the moveable contact has left the fully open position.

In some embodiments of the method, the circuit breaker also includes a trip actuator that includes a plunger having a retracted position and an extended position. The trip actuator may be operably connected to the opening latch when in the extended position. If so, then in the method, causing the opening latch to release may include, by the ETU, generating a signal causes the trip actuator to release the opening latch by extending the plunger from the retracted position to the extended position. In such embodiments, the moveable contact may be connected to a moveable arm; and returning the moveable contact to the fully open position may cause the plunger to move to the retracted position and reset the trip actuator.

In some embodiments of the method, the circuit breaker also includes a closing spring. In such embodiments, detecting that the moveable contact has moved away from the fully open position occurs in response to the closing spring generating a closing force that begins to move the movable contact toward a closed position. When the opening spring returns the moveable contact to the fully open position, the opening spring will do so after the release of the opening latch, which releases the linkage that connects the closing spring to the movable arm.

In other embodiments, a stored energy circuit breaker includes a moveable contact, and a sensor. The sensor is positioned to exhibit a first output condition when the moveable contact is in a fully open position, and to exhibit a second output condition when the moveable contact moves away from the fully open position.

The circuit breaker also may include an extended member that is positioned over the sensor which the moveable contact is in the fully open position, and that is not positioned over the sensor when the moveable contact leaves the fully open position. Alternatively, the extended member may be positioned over the sensor when the moveable contact is in any position other than the fully open position. Other methods of sensing the full open position may include continuous position sensors in place of the extended member interacting with a discrete sensor.

The circuit breaker may include an ETU that is electrically connected to the sensor and that is configured to, in response to detecting that the sensor is in the second output condition, cause the moveable contact to return to the fully open position. The circuit breaker also may include a trip actuator that is electrically connected to the electronic trip unit and that is configured to receive and implement a command to cause the moveable contact to return to the fully open position. The circuit breaker also may include an opening latch that is operably connected to the trip actuator. The circuit breaker also may include an opening spring that is operably connected to the opening latch and to the moveable contact. The opening latch may: (i) when latched, hold the opening spring in a loaded position; and (ii) when unlatched, permit the opening spring to return to an unloaded position.

DETAILED DESCRIPTION

Figure 1A:
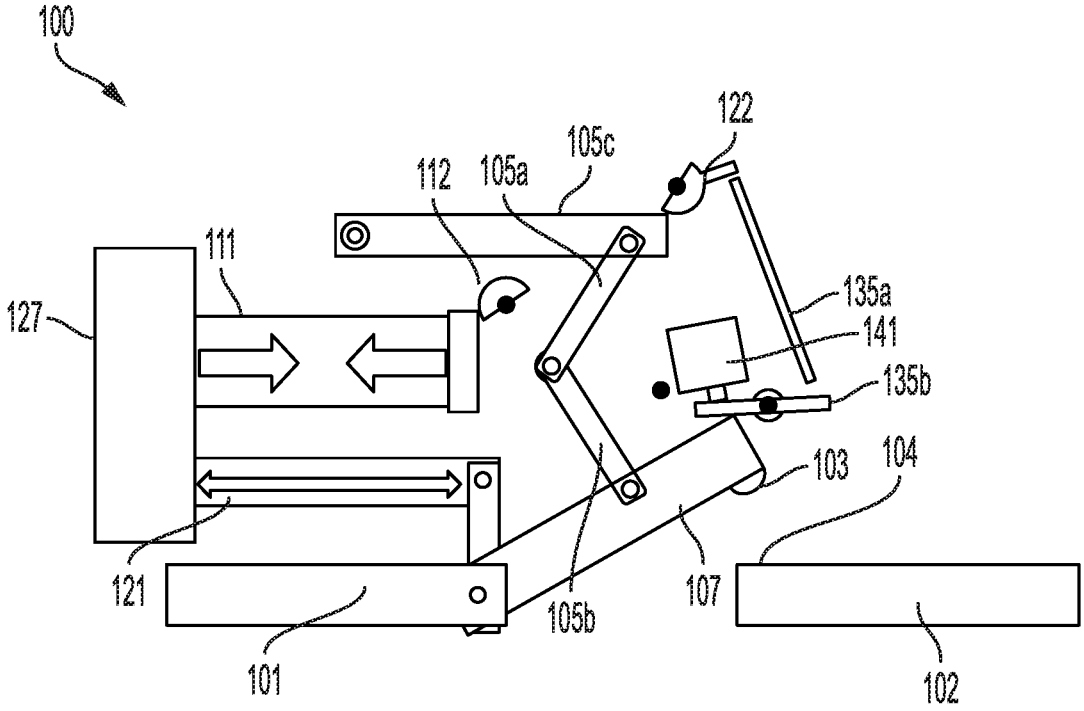
FIG. 1A PRIOR ART
FIGS. 1A-1E are block diagrams that show components of a prior art circuit breaker at various stages of operation, moving from an open position to a closed position.

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" (or "comprises") means "including (or includes), but not limited to." When used in this document, the term "exemplary" is intended to mean "by way of example" and is not intended to indicate that a particular exemplary item is preferred or required.

Other terms that are relevant to this disclosure will be defined at the end of this Detailed Description section.

This disclosure describes a circuit breaker that incorporates a full open sensor that is used to help prevent closure of the breaker in conditions in which a closure could create an unsafe condition.

FIGS. 1A-1E are block diagrams that illustrate certain components of a stored energy circuit breaker 100 such as may exist in the prior art. The circuit breaker is operable to make or break a circuit between a first conductor 101 and a second conductor 102. The first conductor 101 is electrically connected to a moveable conductive arm 107 that includes a moveable contact 103, and the second conductor 102 (which may be a fixed conductive arm) is electrically connected to a fixed contact 104. The fixed contact 104 may be a conductive element that is electrically connected to the second conductor 102, or the fixed contact 104 may simply be an area of the second conductor 102 that will touch the moveable contact 103 when the circuit breaker 100 is in a closed position. When the moveable contact 103 is moved down to touch the fixed contact 104, the switch is closed and the circuit is made. When the moveable contact 103 is moved up and away from the fixed contact 104, the switch is open and the circuit is broken. A mechanical linkage that includes various linkage elements 105*a*, 105*b* and 105*c* will move in response to actuation mechanisms to move the moveable contact 103 toward or away from the fixed contact 104.

In a stored energy circuit breaker 100 such as that shown in FIGS. 1A-1E, the system will include various springs that operate to move the linkage and open, close or trip the breaker. FIGS. 1A-1ED illustrate these and other components of such a prior art circuit breaker at various stages of operation, moving from an open position to a closed position. These includes a closing spring 111 and an opening spring 121, each of which is operably connected to a frame 127 at one end and to one or more linkages at the other end. Optionally, the closing spring 111 may be a compression spring as illustrated by the arrows illustrating a direction of compression force, while the opening spring 121 may be a tension spring as illustrated by the arrows showing a direction of expansion. However, this arrangement may be reversed, or both springs may be of the same type, or other springs may be used such as torsion springs.

Figure 1B:
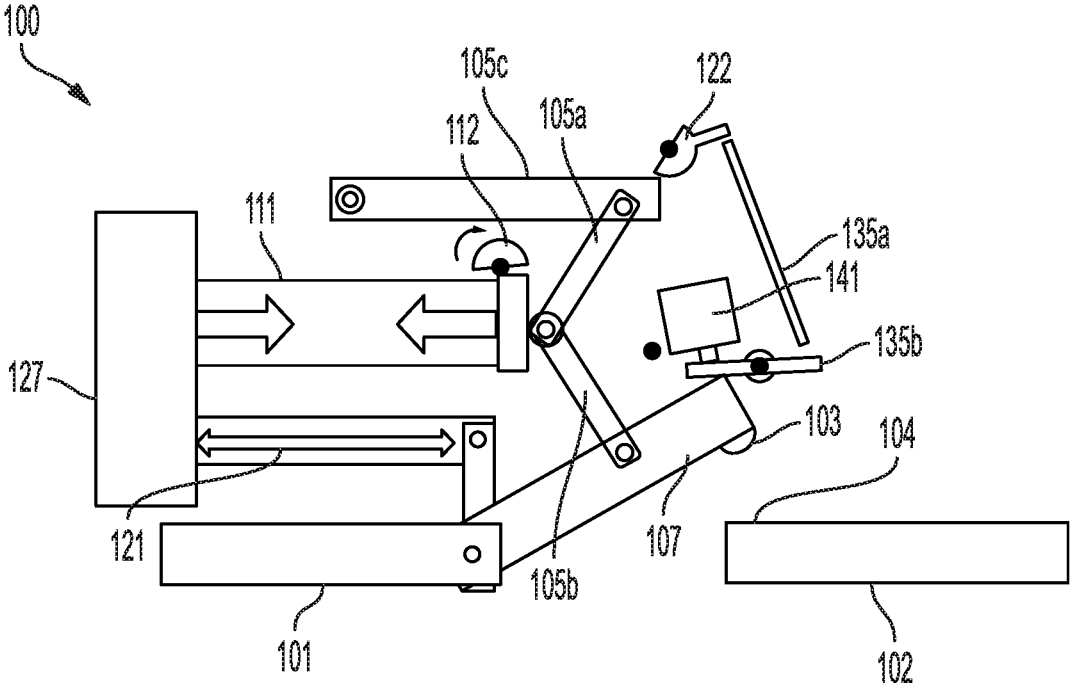
FIG. 1B PRIOR ART
Figure 1C:
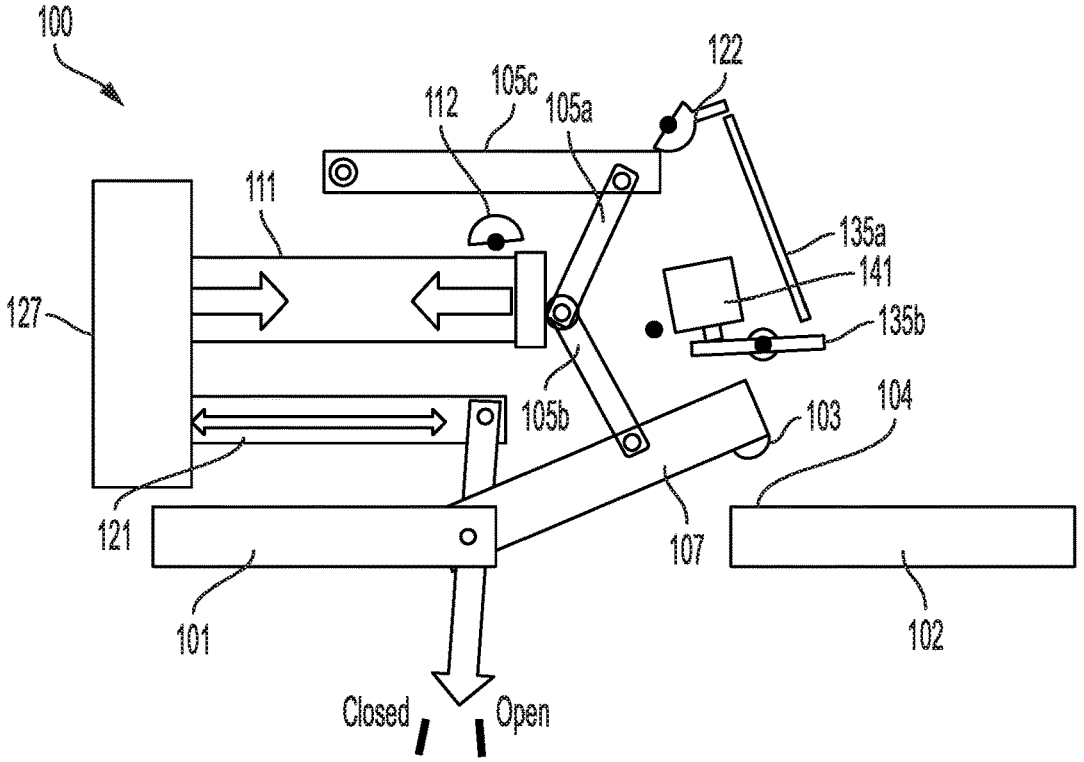
FIG. 1C PRIOR ART

FIG. 1A illustrates the breaker in an open position, ready to close in that the closing spring 111 is mechanically charged, such as by a motor or by human operation, and is held in its compressed position by a closing latch 112. When a close signal releases closing latch 112, FIG. 1B illustrates that the closing spring 111 decompresses (i.e., relaxes) and begins to directly or indirectly push against one or more elements of the mechanical linkage (i.e., elements 105*a* and/or 105*b*) that are operably connected to the moveable arm 107. Another element of the mechanical linkage 105*c* is held fixed by an opening latch 122. FIG. 1C illustrates that as the closing spring 111 further decompresses and pushes against the mechanical linkage elements 105*a*, 105*b*, the mechanical linkage elements 105*a*, 105*b* move the moveable arm 107 downward, which forces the moveable contact 103 toward the fixed contact 104. Ultimately, as illustrated in FIG. 1D, the moveable contact 103 reaches and touches the fixed contact 104, the mechanical linkage elements 105*a*, 105*b* have reached a stop position (illustrated by dot 109), and the circuit is closed.

Figure 1D:
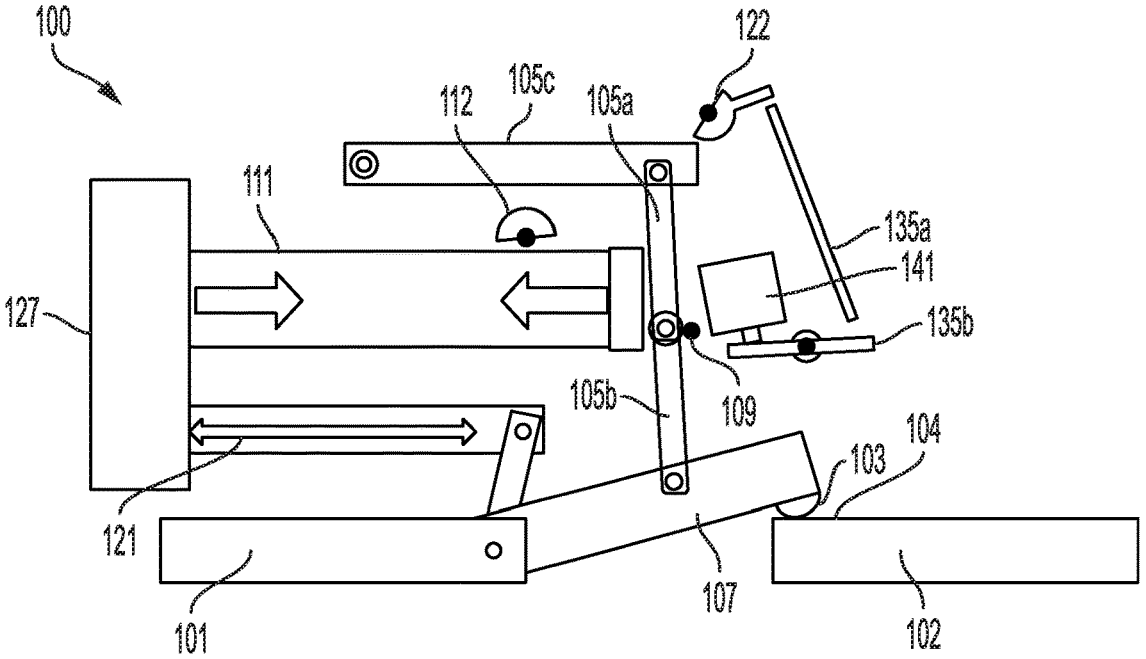
FIG. 1D PRIOR ART
Figure 1E:
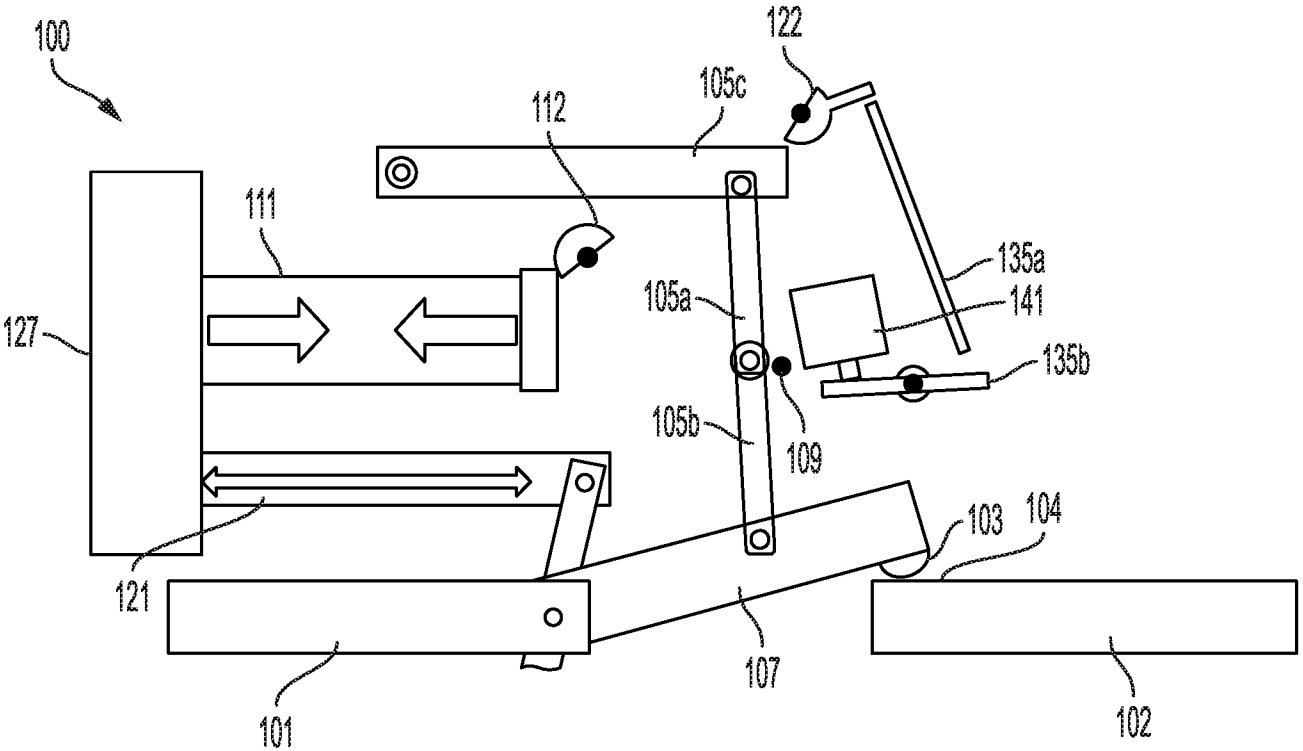
FIG. 1E PRIOR ART

In the position shown in FIG. 1D, the closing spring 111 is fully discharged. In this closed position, the opening spring 121 has been stretched and is therefore charged. In this position, the opening latch 122 holds the links 105*a*, 105*b* of the mechanical linkage in the stop position 109 and keep the opening spring 121 in an outstretched position. The opening latch 122 may be moved to this position manually by a mechanical push-button, remotely by a solenoid, or by the trip actuator 141. After closing is complete and the closing spring 111 has been fully discharged as shown in FIG. 1D, the closing spring 111 will be recharged (in this example, compressed), either automatically by motor activation or manually by operation of a compression mechanism, and the closing latch 112 will be moved to hold the closing spring 111 in the charged position while the links 105*a*, 105*b* of the mechanical linkage remain in the stop position 109. This final position is shown in FIG. 1E.

Figure 2A:
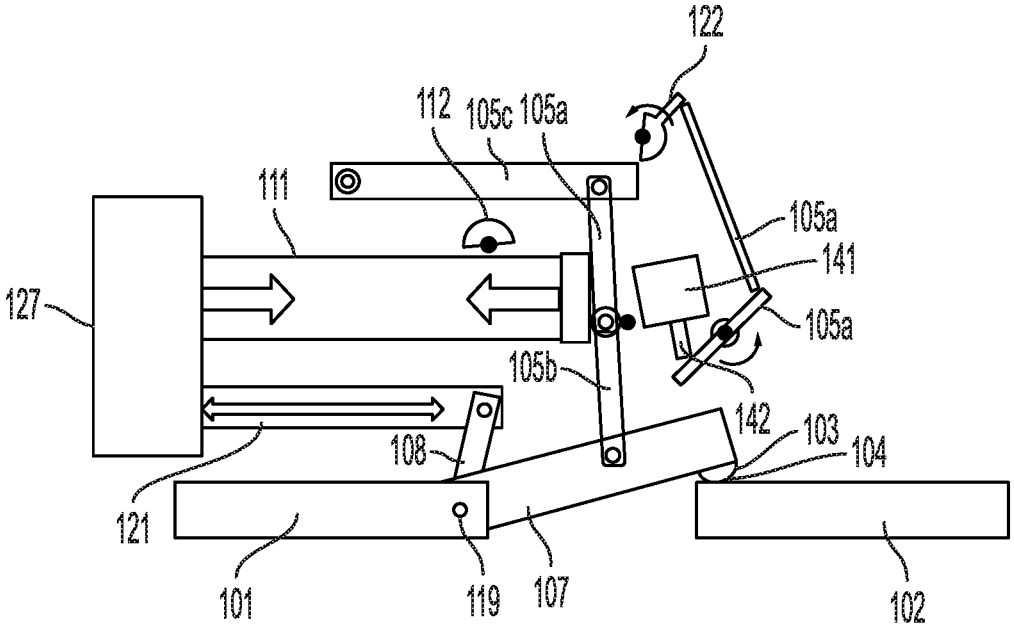
FIG. 2A PRIOR ART
FIGS. 2A-2C are block diagrams that show components of a prior art circuit breaker at various stages of operation, moving from a closed position to an open position.
Figure 2B:
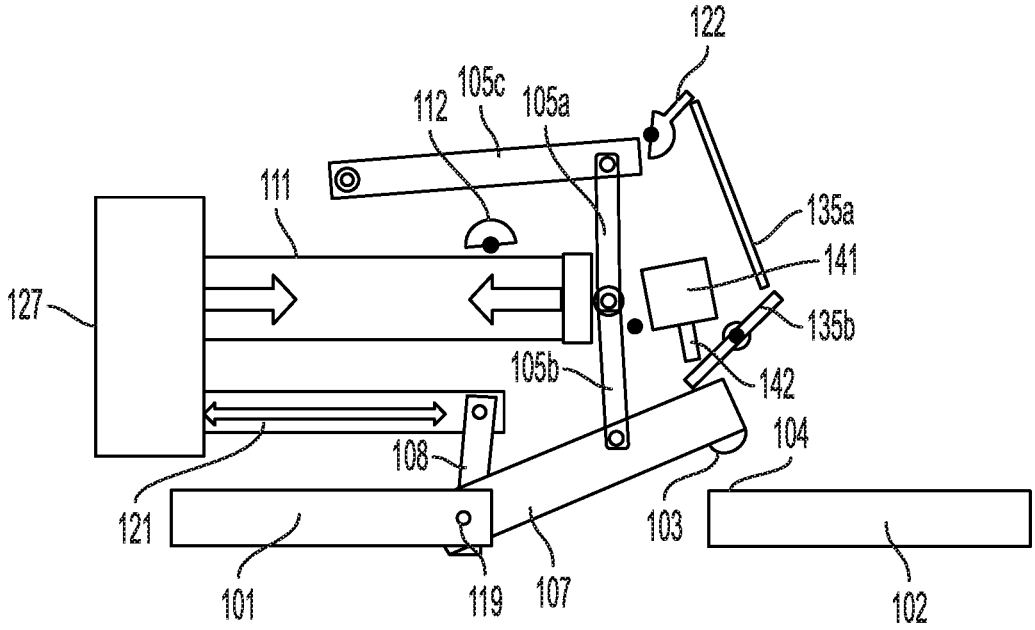
FIG. 2B PRIOR ART
Figure 2C:
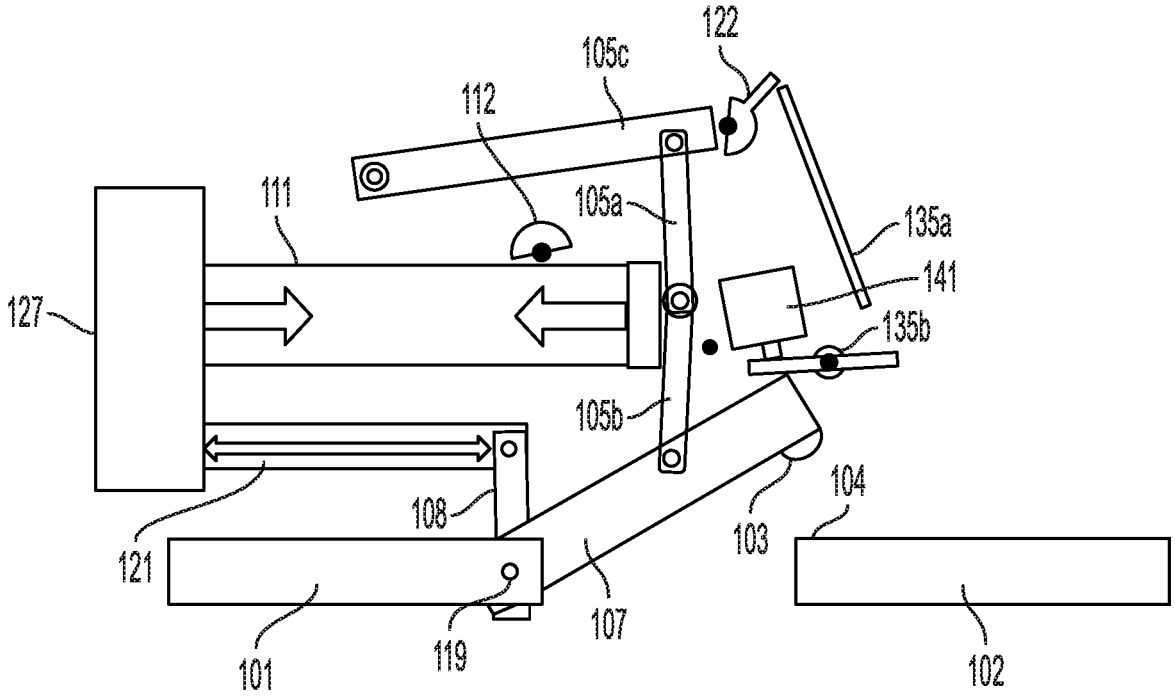
FIG. 2C PRIOR ART

FIGS. 2A-2C are block diagrams that illustrate components of the previously-described prior art circuit breaker as it moves from a closed position to a fully open position. In FIG. 2A, the circuit breaker begins to open as the trip actuator 141 is operated. The trip actuator 141 may include a magnetic latch that is released with an electrical pulse from the circuit breaker's electronic trip unit (ETU). When the magnetic latch in the trip actuator 141 is released, the plunger 142 of the trip actuator 141 may extend and drive a trip linkage 135*a*, 135*b* to move and release the opening latch 122, which releases the opening spring 121 and allows it to recoil to its naturally retracted (i.e., relaxed) position. Releasing the opening latch 122 also removes constraints on the linkage elements 105*a*, 105*b* and 105*c* and decouples the closing spring 111 from the linkage elements 105*a* and 105*b*. The force of closing spring 111 may then be transferred to linkage element 105*c*, which can now move since the opening latch 122 is released. This allows linkage elements 105*a* and 105*b* to then move away from the stop position and allow this retraction of the opening spring 121. As the opening spring 121 relaxes (in this example, expands toward the open position), it directly or indirectly moves a contact linkage 108 that rotates the axle 119, which is rotatably connected to the moveable arm 107 and thus causes the moveable arm 107 to rotate, which pulls the moveable contact 103 away from the fixed contact 104. (Note: In FIGS. 2A-2C, the closing spring 111 has not yet been recharged. However, this is merely an example. Recharging of the closing spring may occur before or after the opening operation of FIGS. 2A-2C.)

In FIG. 2B, as the opening spring 121 continues to relax (i.e., unload), it continues to move the linkage 108, which rotates the moveable arm 107 about the axle 119 and pulls the moveable contact 103 further away from the fixed contact 104 and toward a drive element 135*b* of the trip linkage. The drive element 135*b* is the section of the trip linkage that the trip actuator's plunger 142 previously pushed downward. Pulling the linkage 108 to the left in FIGS. 2A-2C rotates the axle 119, which rotates the moveable arm 107 and causes the free end of the moveable contact 103 to move upward.

In FIG. 2C, the moveable contact 103 has moved into the fully open position and directly or indirectly caused the drive element 135*b* of the trip linkage to move up to reset the plunger 142 into the trip actuator 141. At this point, if the closing spring 111 has not yet been recharged, it may be recharged by motor-driven or manual operation to end up in the position originally shown above in FIG. 1A. The opening latch 122 will also be moved to latch the breaker in the open position in preparation for the next closing operation as shown in FIG. 1A.

Figure 3A:
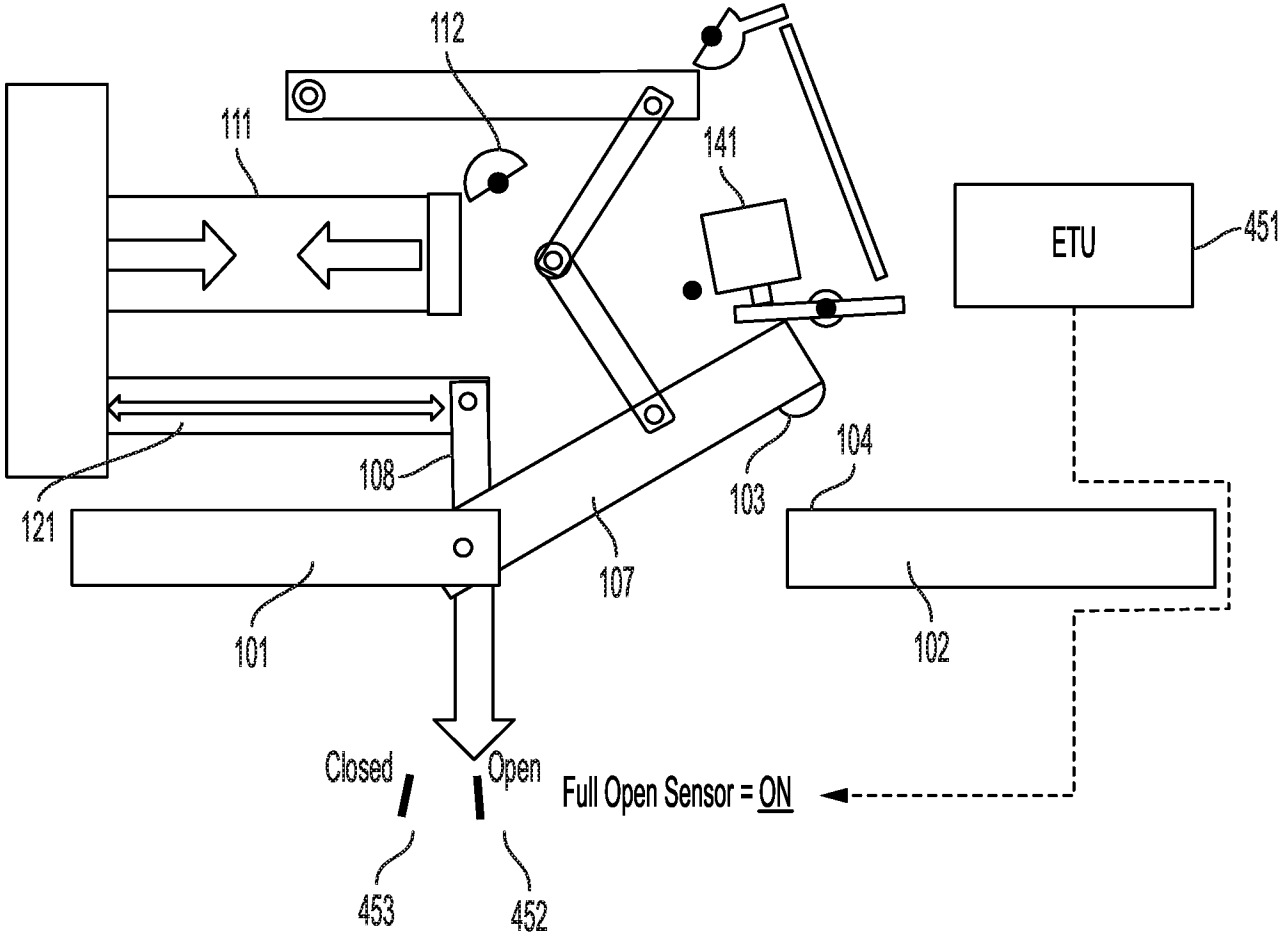
FIGS. 3A-3D are block diagrams that show a mode of operation of a circuit breaker with enhanced close blocking as contemplated by the present disclosure.
Figure 3B:
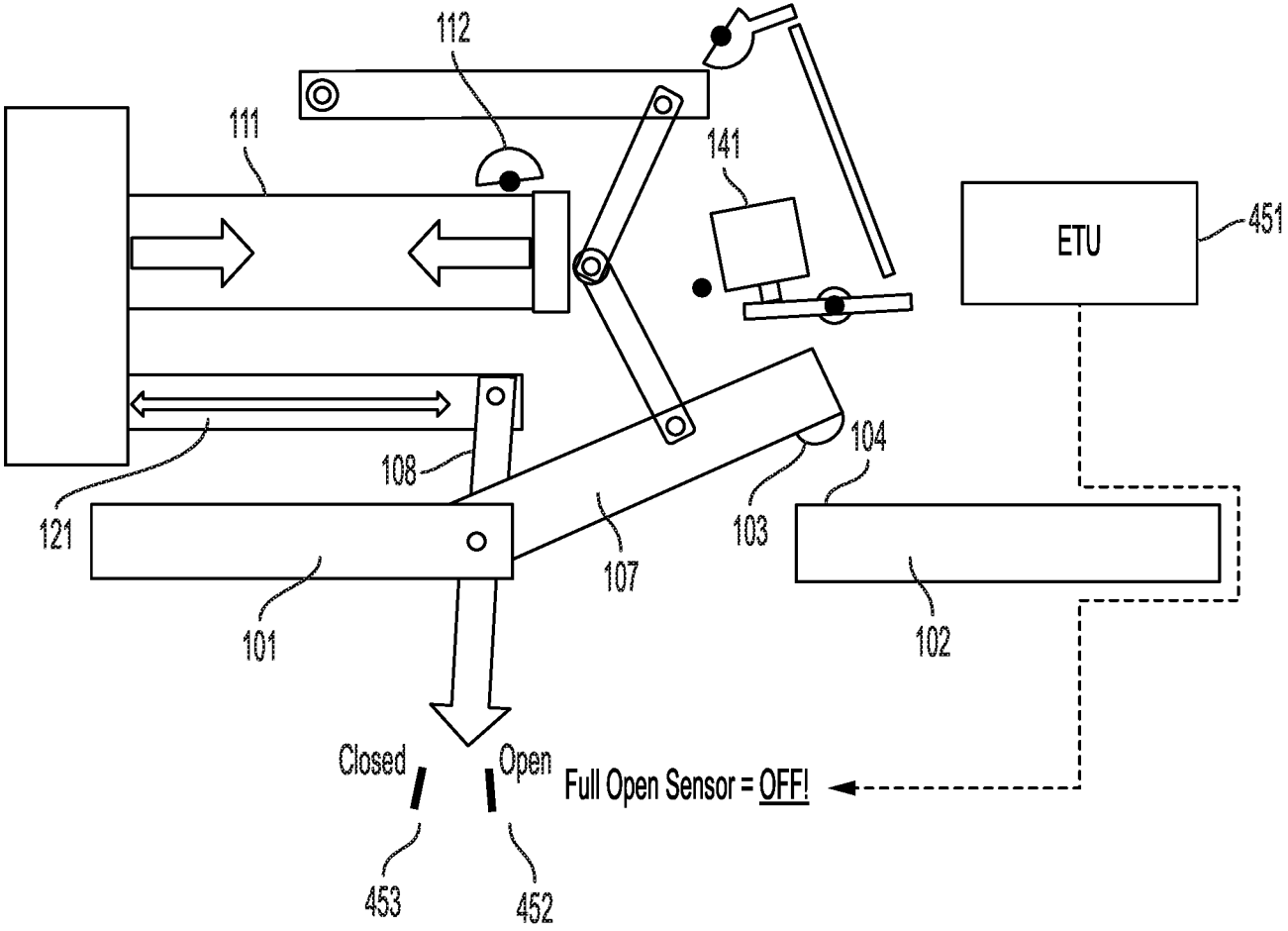

In the prior art embodiments shown in FIGS. 2A-2C, if the close latch 112 receives a command to release from a controller, the command can be overridden by circuitry or programming logic so that the close latch does not in fact release in certain conditions. However, prior art systems are not capable of stopping manual operation of the close latch. To address this, referring to FIGS. 3A-3D this disclosure proposes an enhanced close block method and mechanism in which the circuit breaker includes a full open sensor 452 that is electrically connected to the electronic trip unit (ETU) 451. The ETU 451 may be a conventional ETU or a customized ETU. For example, the ETU may be a programmable device such as a processor that receives signals from one or more external components and uses those signals to determine whether to trip the trip actuator 142. Alternatively, in this disclosure the term ETU also may refer to an electromechanical trip unit that includes current-sensitive and thermal-sensitive devices that determine when to actuate the trip actuator 142 and open the breaker. Optionally, the circuit breaker also may include a full close sensor 453. As shown in FIG. 4, the full open sensor 452 and full close sensor 453 may be switches, pressure sensitive or other sensors positioned near the axle 119 to which the moveable arm 107 is operably connected.

As shown in FIG. 4, the axle 119 may be equipped with a rotatable extended member such as a pin, lever or cam 401 that is positioned to be detected by, and thus change the condition of (i.e., turn on or turn off), the full open sensor 452 when the shaft position rotates to the circuit breaker's fully-open position. It may change the condition of the full close sensor 453 when the axle 119 rotates to the circuit breaker's fully-closed position. The extended member may be positioned over the sensor when the breaker is in the fully-open position as shown in FIG. 4. Alternatively, the extended member may be configured so that it is always positioned over the full open sensor unless the breaker is in the fully-open position. Either configuration will enable the sensor to quickly identify when the circuit breaker begins to move out of the fully-open position. The configuration of a full open sensor shown in FIG. 4 is only an example. As an alternative, a rotational position sensor 405 may detect the rotational position of the axle. Alternatively, the sensor may be a sensor that is positioned in a location where it can directly detect the location of the moveable contact, or where it may detect the length of the opening spring. Other sensor configurations are possible.

Returning to FIG. 3A, in this position the circuit breaker is ready to close. Under normal conditions (i.e., no detection of overcurrent, ground fault, power mismatch or other unsafe conditions) this breaker will operate according to the procedures discussed above for FIGS. 1A-1D and 2A-2C. However, the ETU 451 in the example of FIG. 3A is operating to require close blocking, meaning that it will block the circuit breaker from closing and keep it open. The ETU 451 may do this in response to, for example, a current detector detecting an overcurrent condition, a thermal sensor detecting an overheated condition, or detection of a phase mismatch across two sides of a trip breaker of a main-tie-main system. If a human attempts to manually release the closing latch 112 when the ETU is requiring close blocking, the output of the full open sensor 452 will change (such as changing from an on signal to an off signal or no signal) as shown in FIG. 3B.

Figure 3C:
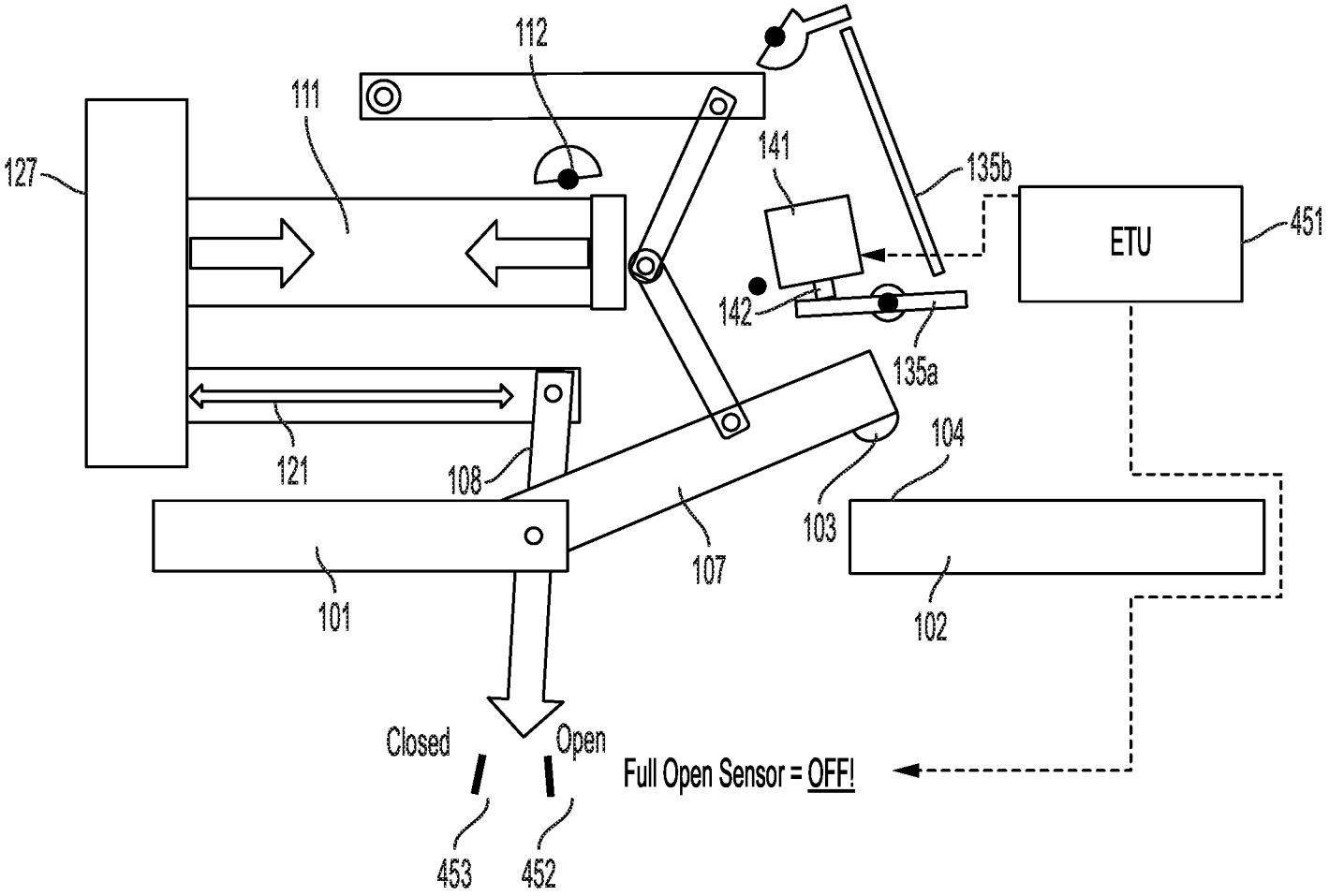
Figure 3D:
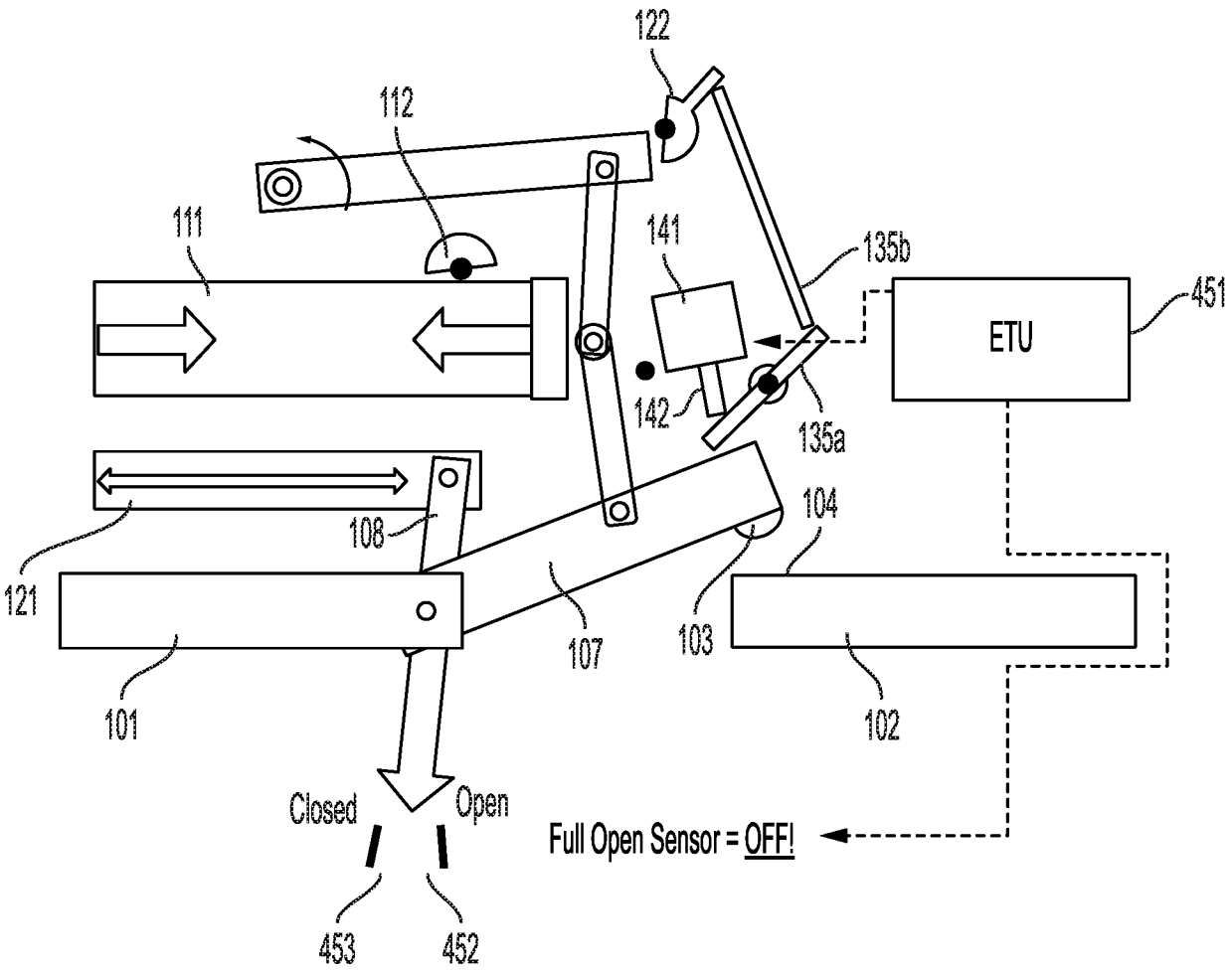
Figure 4:
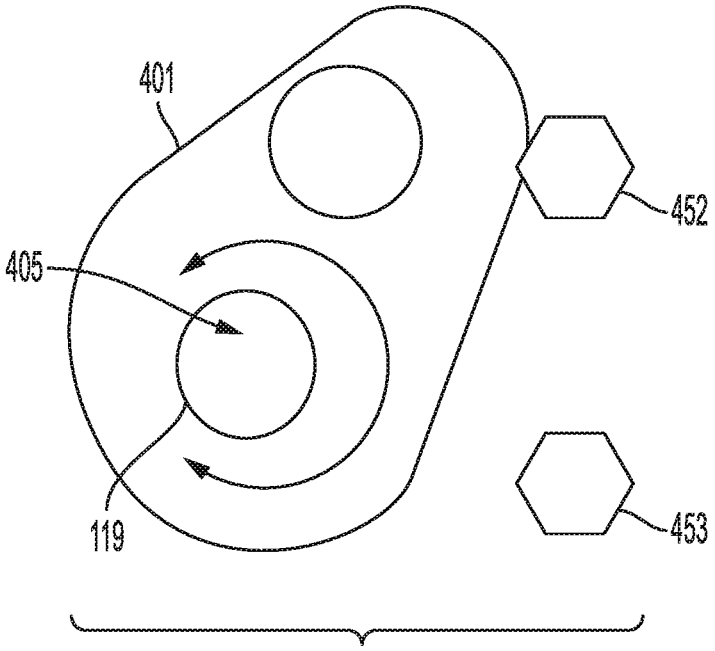
FIG. 4 illustrates components of a circuit breaker that may activate a full close sensor.

Upon detecting this change of condition of the full open sensor 452, as illustrated in FIG. 3C the ETU will immediately send a signal to actuate the trip actuator 141. As illustrated in FIG. 3D this signal causes the plunger 142 of the trip actuator to extend from a retracted position (as in FIG. 3C) to an extended position (as in FIG. 3D), which in turn moves the trip linkage elements 135*a*, 135*b* to release the opening latch 122. Releasing the opening latch 122 releases the tension in the opening spring 121 and causes the opening spring 121 to retract toward an unextended position. The release of the linkage by the opening latch will decouple the closing spring from the linkage elements 135*a*, 135*b*, allowing the opening spring to open. Thus, even though the closing spring 111 began to expand and apply a force to close the breaker, the opening spring 121 will immediately contract and pull the breaker open and prevent it from fully closing, thus maintaining a gap between the moveable contact 103 and the fixed contact 104.

The breaker may then return to the fully open position as shown in FIG. 3A. although the closing spring 111 will be fully discharged at this point (as shown in FIG. 2C). At this point the moveable contact 103 will reset the trip actuator 141, the full open switch 452 may return to delivering a full open signal to the ETU 451, the ETU 451 may cease signaling the trip actuator 141 to actuate, and the closing spring 111 may be recharged.

Thus, the incorporation of a full open switch into a stored energy (i.e., spring release) circuit breaker provides an improved closing prevention capability that can override not only an electronic signal, but also manual operation of the breaker's closing mechanism.

Figure 5:
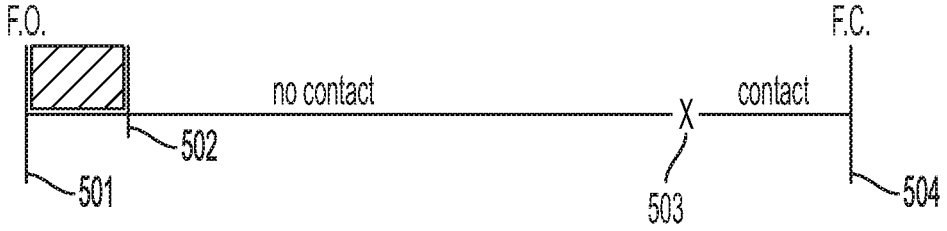
FIG. 5 is a diagram illustrating a sequence of operation of a circuit breaker that incorporates a full open sensor.

It should be noted that the incorporation of the embodiments described above will not necessarily prevent the moveable contact from starting to move in response to a manual close operation. However, it will prevent the moveable contact from touching the stationary contact and closing the circuit when the ETU is operating in a close block condition. An example sequence of operation is explained with reference to FIG. 5. At position 501, the circuit breaker is in a fully open position. When the breaker's closing latch is released, the moveable contact will move toward the stationary contact, and at position 503 the two contacts will touch, eventually coming to rest at a fully closed position at 504. However, the fully open sensor will change its output when the moveable contact reaches position 502, very shortly after the fully open condition is released and well before the contacts touch at 603. For, example, the fully open sensor will actuate before the moveable contact moves halfway through its mechanical range of motion of the closing operation, and in many configurations it will actuate well before that point. By way of example, the fully open sensor may actuate when the moveable contact reaches approximately 10% of its mechanical range of motion, approximately 20% of its mechanical range of motion, approximately 30% of its mechanical range of motion, approximately 40% of its mechanical range of motion, or some other set position. Thus, there will be a short period of movement by the moveable contact between positions 501 and 502. When the ETU detects the fully open sensor's change in signal at position 302, the ETU will trigger the trip actuator, which releases the opening latch and causes the moveable contact to return to the fully open position at 501 rather than continue to move to positions 503 and 504.

It should also be noted that the description above, and in particular the figures, describe only an example circuit breaker operation, with only the functional elements of a circuit breaker that are necessary to describe the invention shown. In practice, other arrangements may be used, and the figures' illustrations that show certain components as interconnected does not necessarily mean that the components physically contact each other. The use of the word "operably" connected in the description and claims denotes, as defined below, that the parts need not physically touch each other.

In this document, when terms such "first" and "second" are used to modify a noun, such use is simply intended to distinguish one item from another, and is not intended to require a sequential order unless specifically stated. The term "approximately," when used in connection with a numeric value, is intended to include values that are close to, but not exactly, the number. For example, in some embodiments, the term "approximately" may include values that are within +/−10 percent of the value.

In this document, the term "connected", when referring to two physical structures, means that the two physical structures touch each other. Devices that are connected may be secured to each other, or they may simply touch each other and not be secured.

In this document, the term "operably connected", when referring to two physical structures, means operation (i.e., movement) of one structure will cause the other structure to responsively move. Operably connected structures may be physically connected to each other, or they may be indirectly connected via one or more intermediate structures.

In this document, the term "electrically connected", when referring to two electrical components, means that a conductive path exists between the two components. The path may be a direct path, or an indirect path through one or more intermediary components.

When used in this document, relative terms of position such as "up" and "down", "upper" and "lower", and "upward" and "downward" are not intended to have absolute orientations but are instead intended to describe relative positions of various components with respect to each other. For example, a first component may be an "upper" component and a second component may be a "lower" component when a device of which the components are a part is oriented in a first direction. The relative orientations of the components may be reversed, or the components may be on the same plane, if the orientation of the structure that contains the components is changed. The claims are intended to include all orientations of a device containing such components.

The features and functions described above, as well as alternatives, may be combined into many other different systems or applications. Various alternatives, modifications, variations or improvements may be made by those skilled in the art, each of which is also intended to be encompassed by the disclosed embodiments.

The invention claimed is:

1. A circuit breaker comprising:

a moveable contact;

an opening spring that is operably connected to the moveable contact;

a sensor that is operable to exhibit a first output condition when the moveable contact is in a fully open position and a second output condition when the moveable contact leaves the fully open position;

an electronic trip unit that is electrically connected to the sensor and that is configured to block the circuit breaker from closing by, in response to detecting that the sensor is in the second output condition indicating that the moveable contact has left the fully open position, generating a signal that will cause the opening spring to return the moveable contact to the fully open position;

a trip actuator;

an opening latch that, when in a latched position, will allow the opening spring to reach a loaded position, wherein:

the signal that will cause the opening spring to return the moveable contact to the fully open position is a signal that will cause the trip actuator to release the opening latch, releasing the opening latch will cause the opening spring to unload and return to a relaxed condition, and the opening spring returning to the relaxed condition will return the moveable contact to the fully open position.

2. The circuit breaker of claim 1, wherein:

the trip actuator comprises a plunger having a retracted position and an extended position, wherein the extended position is operably connected to the opening latch; and the signal that will cause the trip actuator to release the opening latch is a signal that will cause the plunger to move from the retracted position to the extended position.

3. The circuit breaker of claim 1, wherein the moveable contact, when in the fully open position, is operably positioned to reset the trip actuator.

4. The circuit breaker of claim 1, further comprising:

a moveable arm that is operably connected to the moveable contact;

an axle that is operably connected to the moveable contact; and a linkage that operably connects the opening spring with the moveable arm via the axle.

5. The circuit breaker of claim 4, further comprising:

an extended member that is operably connected to the axle, wherein the sensor is positioned to detect the extended member when a position of the moveable contact corresponds to the fully open position.

6. A method of operating a circuit breaker, the method comprising:

in a circuit breaker having a moveable contact, an opening spring, a sensor and an electronic trip unit:

by the sensor:

detecting that the moveable contact is in a fully open position;

after detecting that the moveable contact is in the fully open position;

detecting that the moveable contact has moved away from the fully open position; and in response to detecting that the moveable contact has moved away from the fully open position, changing from a first output condition to a second output condition, by the electronic trip unit:

detecting that the sensor has changed to the second output condition; and in response detecting that the sensor has changed to the second output condition, causing the opening spring to return the moveable contact to the fully open position; and an opening latch that is operably connected to the opening spring, wherein causing the opening spring to return the moveable contact to the fully open position is effected as the electronic trip unit causes the opening latch to release, which in turn causes the opening spring to return to an unloaded condition.

7. The method of claim 6, wherein:

the opening spring is operably connected to a lever that is operably connected to an axle;

the moveable contact is operably connected to a moveable arm that is also operably connected to the axle;

causing the opening spring to return to the unloaded condition turns the axle;

turning the axle rotates the moveable arm; and rotating the moveable arm moves the moveable contact to the fully open position.

8. The method of claim 7, wherein:

the axle comprises an extended member; and detecting that the moveable contact is in the fully open position comprises, by the sensor, detecting that the extended member has moved away from the sensor.

9. The method of claim 6, wherein:

the circuit breaker further comprises a trip actuator;

the trip actuator includes a plunger having a retracted position and an extended position, and the trip actuator is operably connected to the opening latch when in the extended position; and causing the opening latch to release comprises, by the electronic trip unit, generating a signal causes the trip actuator to release the opening latch by extending the plunger from the retracted position to the extended position.

10. The method of claim 9, wherein:

the moveable contact is connected to a moveable arm; and returning the moveable contact to the fully open position causes the plunger to move to the retracted position and reset the trip actuator.

11. The method of claim 6, wherein:

the circuit breaker further comprises a closing spring;

detecting that the moveable contact has moved away from the fully open position occurs in response to the closing spring generating a closing force that begins to move the movable contact toward a closed position; and causing the opening spring to return the moveable contact to the fully open position removes the closing force.

12. A stored energy circuit breaker comprising:

a moveable contact;

a sensor that is positioned to:

exhibit a first output condition when the moveable contact is in a fully open position, and exhibit a second output condition when the moveable contact moves away from the fully open position;

an electronic trip unit that is electrically connected to the sensor and that is configured to, in response to detecting that the sensor is in the second output condition, cause the moveable contact to return to the fully open position;

a trip actuator that is electrically connected to the electronic trip unit and that is configured receive and implement a command to cause the moveable contact to return to the fully open position; and an opening latch that is operably connected to the trip actuator.

13. The circuit breaker of claim 12, further comprising an extended member that is positioned over the sensor which the moveable contact is in the fully open position, and that is not positioned over the sensor when the moveable contact leaves the fully open position.

14. The circuit breaker of claim 12, further comprising an extended member that is positioned over the sensor when the moveable contact is in any position other than the fully open position.

15. The circuit breaker of claim 12, further comprising an opening spring that is operably connected to the opening latch and to the moveable contact.

16. The circuit breaker of claim 15, wherein the opening latch:

when latched, holds the opening spring in a loaded position; and when unlatched, permits the opening spring to return to an unloaded position.

* * * * *